United States Patent [19]

Eaton

[11] Patent Number: 4,796,727

[45] Date of Patent: Jan. 10, 1989

[54] FOLDING STEP LADDER

[76] Inventor: Earl V. Eaton, Box 1162, Eagle, Colo. 81631

[21] Appl. No.: 151,008

[22] Filed: Feb. 1, 1988

[51] Int. Cl.[4] ..... E06C 1/22

[52] U.S. Cl. ..... 182/168; 182/169; 182/172

[58] Field of Search ..... 182/166–173

[56] References Cited

U.S. PATENT DOCUMENTS

| | | | |
|---|---|---|---|
| 229,472 | 6/1880 | Rood | 182/168 |
| 475,935 | 5/1892 | Crews | 182/169 |
| 495,108 | 4/1893 | Crews | 182/169 |
| 838,831 | 12/1906 | Wilson . | |
| 987,585 | 3/1911 | Mayer . | |
| 1,379,419 | 5/1921 | Reeves . | |
| 1,441,528 | 1/1923 | Saccone . | |
| 2,261,479 | 11/1941 | Moen | 182/169 |
| 2,885,133 | 5/1959 | Nelson | 182/169 |
| 3,447,632 | 6/1969 | Boyd . | |
| 3,474,883 | 10/1969 | Weis | 182/169 |
| 3,878,917 | 4/1975 | McBride | 182/172 |
| 4,298,093 | 11/1981 | Wing | 182/167 |
| 4,433,754 | 2/1984 | Beach | 182/172 |
| 4,600,080 | 7/1986 | Forrester | 182/169 |
| 4,641,729 | 2/1987 | Beck | 182/172 |

*Primary Examiner*—Reinaldo P. Machado
*Attorney, Agent, or Firm*—Klaas & Law

[57] ABSTRACT

A folding step ladder is provided wherein a ladder having side leg portions with at least three steps extending between and fixedly connected to the side leg portions is supported by at least a pair of support legs pivotally mounted on the top end portion of the ladder for pivotal movement in a plane parallel to the plane extending between the side leg portions and at least one additional support leg pivotally mounted on the top end portion of the ladder for pivotal movement in a plane parallel to the planes of the side leg portions and wherein each of the pair of support legs and the additional leg are provided with slidable extension tubes so that the ladder may be supported to extend in a vertical direction on any supporting surface. Also, another ladder is connected to the folding step ladder for relative sliding movement therebetween so as to provide a folding extension step ladder.

20 Claims, 3 Drawing Sheets

FIG. 5
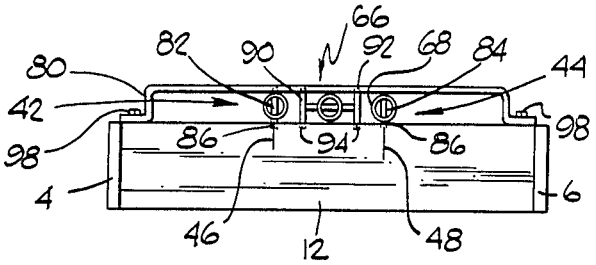
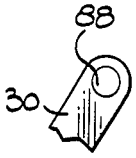
FIG 6
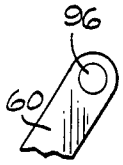
FIG. 7
FIG. 8
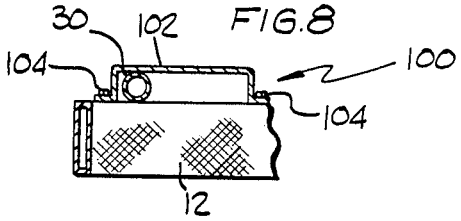
FIG. 9
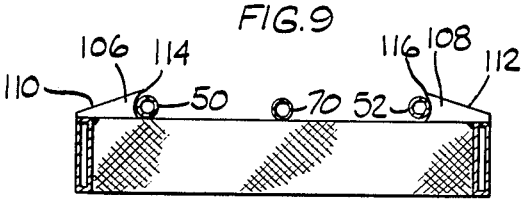
FIG. 10
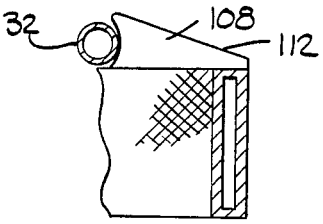
FIG. 11
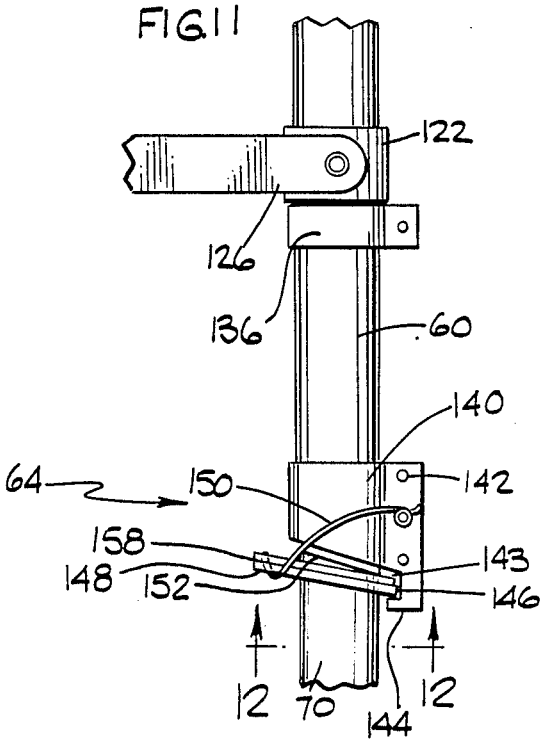
FIG. 12
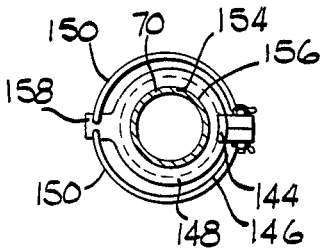

FOLDING STEP LADDER

FIELD OF THE INVENTION

This invention relates generally to a folding step ladder and more particularly to a folding step ladder that is readily transportable and may be properly positioned on any supporting surface.

BACKGROUND OF THE INVENTION

It is well known that there are many different kinds of folding step ladders. Probably, the most common type comprises the steps portion of a ladder comprising a pair of opposed side legs having steps extending therebetween and connected thereto. A pair of support legs are pivotally mounted on the steps portion so that when extended, the step ladder will be supported on four legs. One problem with this kind of step ladder is that the support legs are at a fixed distance so that it is necessary to have a level supporting surface for the step ladder. A modification of the above-described step ladder comprises the use of only one support leg pivotally mounted on the steps portion so that the ladder is supported on three legs. While this modification is lighter, it still requires a level supporting surface for the proper use thereof.

BRIEF DESCRIPTION OF THE INVENTION

This invention provides a folding step ladder wherein the steps portion of the folding step ladder comprises two side leg portions having steps extending between and connected thereto and has at least three support legs pivotally mounted thereon. At least two of the support legs are pivotally mounted so that they move in a plane substantially parallel to the steps and one additional support leg that is pivotally mounted for movement in a plane substantially parallel to the planes of the side leg portions. Each of the support legs has extension means and locking means so that the linear extent of each support means may be adjusted as desired and then locked in the adjusted position so that the folding step ladder may be properly supported on any surface.

In a preferred embodiment of the invention, the folding step ladder comprises a ladder having at least a pair of opposed side leg portions having inner and outer surfaces and having at least three spaced apart steps extending between and fixedly connected to the inner surfaces of the side leg portions. The ladder has a top end portion, a bottom end portion, a front side and a back side, a length equal to the extent of the side leg portions, a width equal to the distance between the outer surfaces of the side leg portions and a depth extending between the front side and the back side. At least a pair of support legs each having a top end section and a bottom end section are pivotally mounted at their top end sections to the top end portion of the ladder so that the pivot axes thereof extend generally in a depthwise direction so that the pair of support legs will move in a plane substantially parallel to the steps. At least one additional support leg having a top end section and a bottom end section is pivotally mounted at its top end section to the top end portion of the ladder so that the pivot axis thereof extends generally in a widthwise direction so that the one additional support leg moves in a plane substantially parallel to the planes of the side leg portions. Extension means are provided for each of the support legs so that the linear extent of each of the support legs may be adjusted as desired. Locking means are provided so as to hold each leg at its adjusted desired length so that the ladder may be supported in a vertical condition on any supporting surface. The extension means permit the support legs to have a linear extent greater or lesser than the length of each of the side leg portions.

BRIEF DESCRIPTION OF THE DRAWINGS

An illustrative and presently preferred embodiment of the invention is shown in the accompanying drawing in which:

FIG. 5 is a top plan view of FIG. 4 rotated 90 degrees;

FIG. 6 is a partial side elevational view of the top end section of one of the two support legs;

FIG. 7 is a partial side elevational view of the top end section of the one additional support leg;

FIG. 8 is a cross-sectional view taken on the line 8—8 of FIG. 2;

FIG. 9 is a cross-sectional view taken on the line 9—9 of FIG. 3;

FIG. 10 is an enlarged view of a portion of FIG. 9;

FIG. 11 is a side elevational view of the locking means;

FIG. 12 is a cross-sectional view taken on the line 12—12 of FIG. 11;

DETAILED DESCRIPTION OF THE INVENTION

Figures 1, 2, 3, 4:
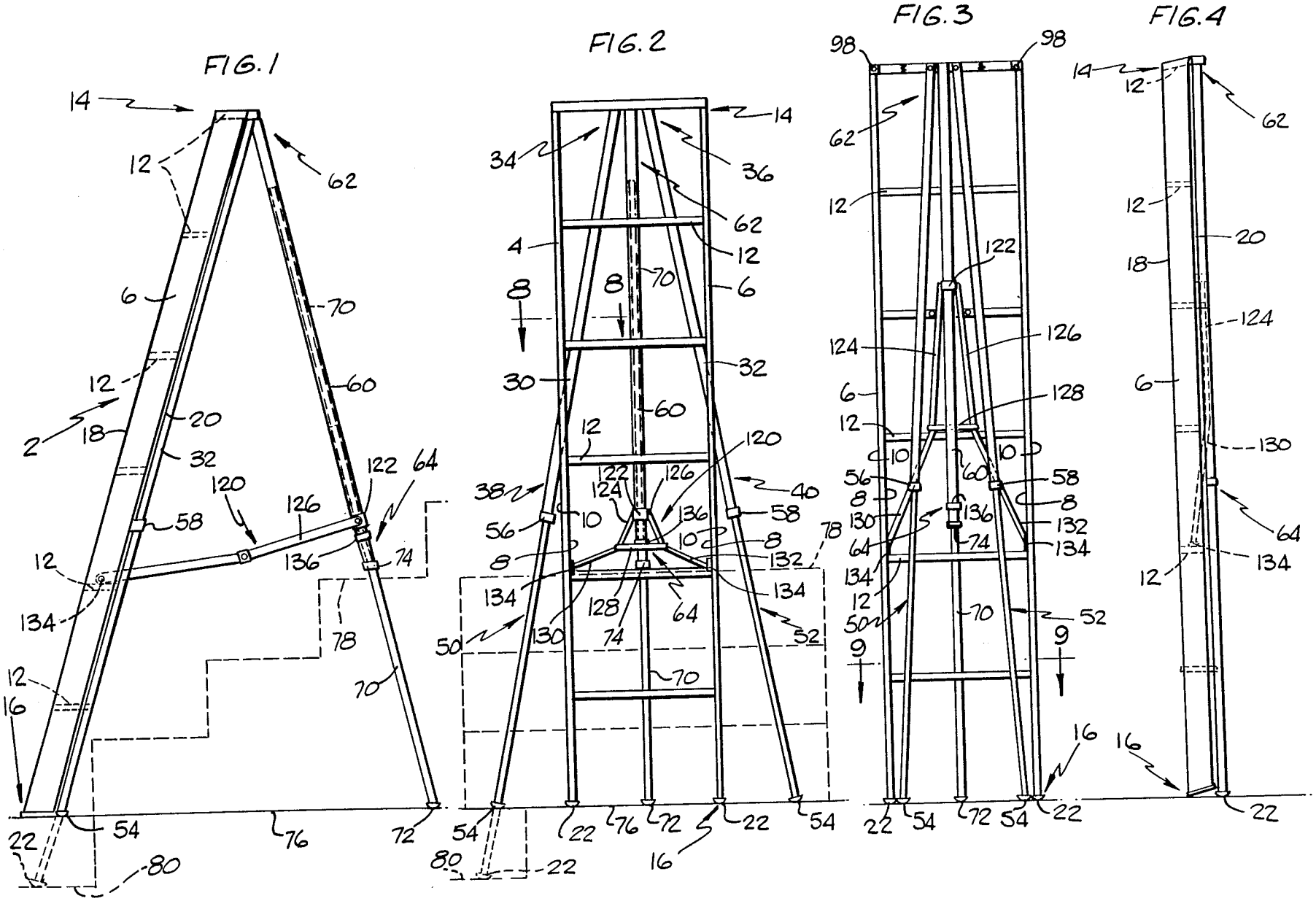
FIG. 1 is a side elevational view of the folding step ladder in an opened position for use.
FIG. 2 is a front elevational view of FIG. 1.
FIG. 3 is a rear elevational view of the folding step ladder in a closed position.
FIG. 4 is a side elevational view of FIG. 3.

The preferred embodiment of the invention is illustrated in FIGS. 1–12 and comprises a ladder 2 having a pair of opposed side edge portions 4 and 6 having inner 8 and outer 10 surfaces. A plurality of steps 12 extend between the inner surfaces 8 and are fixedly connected thereto. The ladder 2 has a top end portion 14, a bottom end portion 16, a front side 18, a back side 20, a length equal to the longitudinal extent of the side edge portions 4 and 6 between the top end portion 14 and the bottom end portion 16, a width equal to the distance between the outer surfaces 10 and a depth extending between the front side 18 and the back side 20. The side edge portions 4 and 6 are each provided with feet 22 which, if desired, can be conventional pivotally mounted feet (not shown).

At least a pair of support legs 30 and 32, having top end sections 34 and 36 and bottom end sections 38 and 40, are pivotally mounted on the ladder 2 by pivot means 42 and 44 (FIG. 5) for pivoting around axes 46 and 48 extending in a depthwise direction and generally parallel to each other so that the pair of support legs 30 and 32 move in planes that are generally parallel to the steps 12. Extension means 50 and 52, slidably mounted in the pair of support legs 30 and 32, are provided for varying the linear extent of the two support legs 30 and 32 and each of the extension means 50 and 52 are provided with feet 54. Locking means 56 and 58 are provided for locking the extension means 50 and 52 at any desired linear extent. When the pair of support legs 30 and 32 are in the opened position, the distance between the feet 54 is greater than the width of the ladder 2.

At least one additional support leg 60, having a top end section 62 and a bottom end section 64, is pivotally mounted on the ladder 2 by pivot means 66 for pivoting around an axis 68 extending generally in a widthwise direction so that the one additional support leg 60 moves in a plane substantially parallel to the planes of the side leg portions 4 and 6. Extension means 70, slidably mounted in the one additional support leg 60, are provided for varying the linear extent of the one additional support leg 60 and are provided with a foot 72. Locking means 74 are provided for locking the extension means 70 at any desired linear extent.

Various uses of the ladder 2 are illustrated by solid and dashed lines in FIGS. 1 and 2. If the surface 76 on which the support legs 30, 32 and 60 are to be placed is substantially even, then the extension means 50, 52 and 70 are moved out to the positions illustrated by the solid lines in FIGS. 1 and 2. If the ladder 2 is to be used on a stair case 78, the extension means 70 will remain in the one addition support leg 60 as illustrated by the dashed lines. If the leg 30 has to be supported on a lower surface 80, then the extension means 50 would be moved out further as indicated by the dashed lines. Therefore, the ladder 2 may be supported in a vertical condition on any surface. If the ladder 2 is always going to be used on a flat surface, then the extension means 50, 52 and 70 may be omitted and the length of the pair of support legs 30 and 32 and the additional support leg 60 may be increased the required amount.

The pivot means 42, 44 and 66 are illustrated in FIG. 5 and comprise a U-shaped support member 80 secured to the top step 12 of the ladder 2. A pair of pivot pins 82 and 84 have one end secured to the support member 80 and the other end thereof is adapted to be seated in a recess 86 in the top step 12 when in an assembled relationship. Each of the two support legs 30 and 32, as illustrated by support leg 30 in FIG. 6, is provided with an opening 88 so that the support leg 30 may be pivotally mounted on the pivot pin 82 or 84. A pair of spaced apart support bars 90 and 92 have one of their ends secured to the support member 80 and the other ends thereof is adapted to be received in recesses 94 in the top step 12 when in an assembled relationship. As illustrated in FIG. 7, the one additional support leg 60 is provided with an opening 96. A pivot pin 98 is passed through the opening 96 and then secured to the support bars 90 and 92 to provide the pivotal mounting for the one additional support leg 60. After the one additional support leg 60 has been mounted, the two support legs 30 and 32 are mounted on the pivot pins 82 and 84 and the assembly is positioned with the other ends of pivot pins 82 and 84 in the recesses 86 and the other ends of the support bars 90 and 92 in the recesses 94 and the U-shaped support member 80 which is then secured to the top step 12 by suitable means such as a threaded bolt 98 in a threaded opening in the step 12.

A guide and retaining means 100 for the support leg 30 is illustrated in FIG. 8 and comprises a U-shaped bracket 102 which is secured to the fourth step 12 from the bottom of the ladder 2 by suitable means such as threaded bolts 104 in a threaded opening in the step 12. The guide and retaining means 100 permit the movement of the support leg 30 between the opened use position illustrated in FIG. 1 and a stored or carrying closed position as illustrated in FIGS. 3 and 4 while retaining the leg 30 in a position close to the ladder 2. Similar means are provided for guiding and retaining support leg 32. Retaining means are provided for retaining the two support legs in a closed position for storage or transporting and comprise a pair of members 106 and 108 having inclined surfaces 110 and 112 and recesses 114 and 116. As the support legs 30 and 32 are moved from an opened to a closed position, the guide and retaining means 100 cause the extension means 50 and 52 to contact the inclined surfaces 110 and 112. The movement of the extension means 50 and 52 over the inclined surfaces 110 and 112 causes a flexing in the extension means 50 and 52 so that when the end of the inclined surfaces are reached, the extension members 50 and 52 will be urged toward the step 12. The guiding and retaining means 100 are located relative to the members 106 and 108 so that a slight force is applied to the extension means 50 and 52 to hold them against the recesses 114 and 116.

A brace means 120 is illustrated in FIGS. 1–4 and comprise a tubular member 122 mounted for sliding movement over the one additional support leg 60. A pair of arms 124 and 126 are pivotally mounted on the tubular member 122 and are secured to a cross member 128. Another pair of arms 130 and 132 are secured to the cross member 128 and are pivotally mounted on the second step 12 from the bottom of ladder 2 at locations next to the side leg portions 4 and 6 by pivot means 134. A stop member 136 is secured to the one additional support leg 60 so as to limit the downward movement of the tubular member 122 so as to position the one additional support leg 60 in an opened position. As illustrated in FIG. 4, the arms 130 and 132 extend at an angle to arms 124 and 126 so that when the support legs 30 and 32 and the one additional support leg 60 are in a closed position, the arms 130 and 132 are located between the support legs 30 and 32 and the ladder 2. This relationship ensures that the one additional support leg 60 cannot be moved to an opened position until the support legs 30 and 32 have been moved to an opened position.

The locking means 74 are more specifically illustrated in FIG. 11 and comprise a support member 140 clamped to the bottom end section 64 next to the end of the one additional support leg 60 by suitable means 142, such as nuts and bolts, to prevent movement of the support member 140 relative to the one additional support leg 60. A cavity 143 is formed in the support member 140 and a pair of flanges 144 are provided so as to loosely confine a portion 146 of a locking member 148 in the cavity 143. A pair of springs 150 are secured to the support member 140 and the locking member 148 and urge the locking member to move toward the beveled bottom edge 152 of the one additional support leg 60 to prevent upward movement of the extension means 70 back into the one additional support leg 60. The locking member 148 has a central opening 154 having a diameter slightly greater than the diameter of the outer surface 156 of the extension means 70. When it is desired to move the extension means 70 into or out of the one additional support leg 60, a force is applied to the tab portion 158 of the locking member 148 to move the locking member 148 to a position where the extension means 70 may be freely moved through the locking member 148. In the canted position illustrated in FIG. 11, the locking member 148 contacts the extension means 70 to prevent movement of the extension means 70 back into the one additional support leg 60. The locking means 56 and 58 are similar to the locking means 74.

Figure 15:
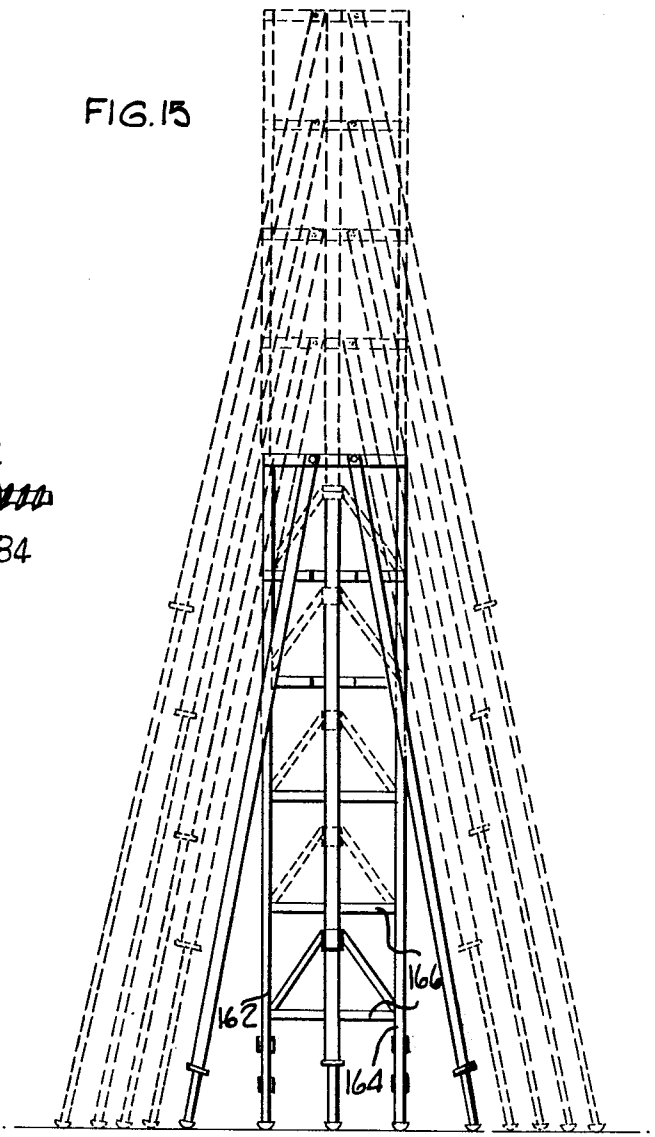
FIG. 15 is a front elevational view of FIG. 13.
Figure 14:
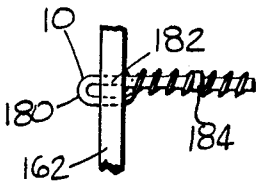
FIG. 14 is a side elevational view of a locking means.
Figure 13:
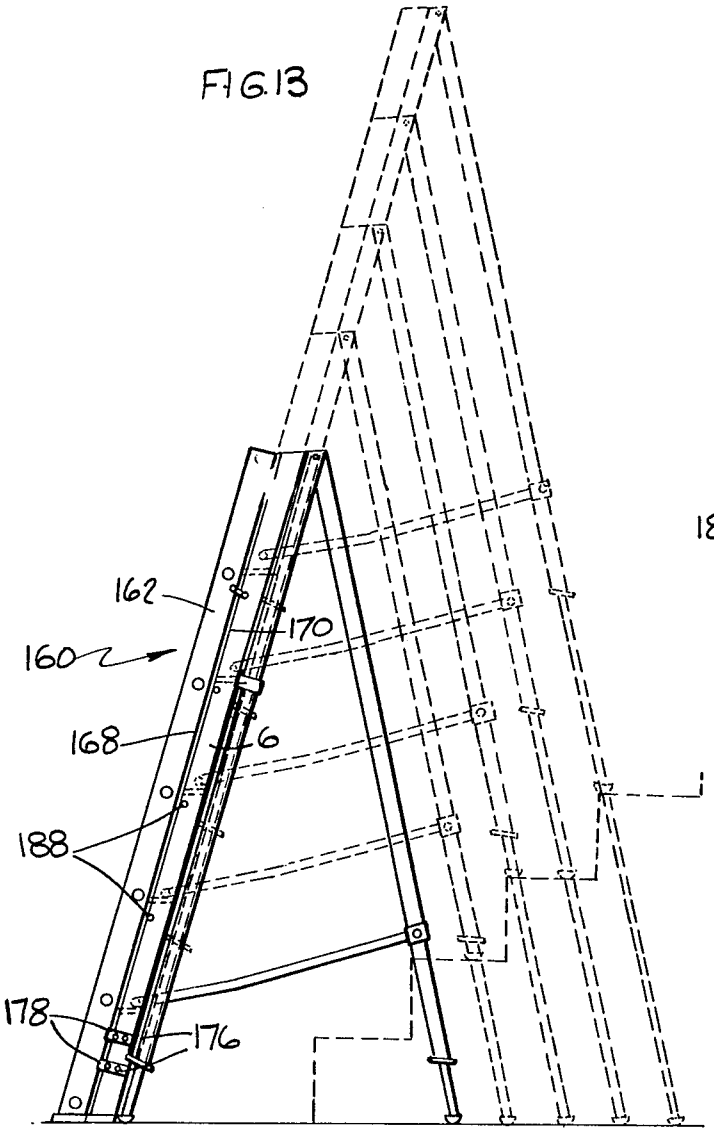
FIG. 13 is a side elevational view of a modification of the invention.

The conversion of the folding step ladder of FIGS. 1–12 to a folding extension ladder is illustrated in FIGS. 13–15. The folding step ladder of FIGS. 1–12 is slidably mounted on a base ladder 160 having side edge portions 162 and 164 and a plurality of steps 166 extending between and secured to the side edge portions 162 and 164. Relative sliding movement is provided by flange portions 168 on each of the side edge portions 162 and 164 and flange portions 170 on each of the side edge portions 4 and 6. Guide and retaining means 172 are secured to each side edge portion 162 and 164 and have a lip portion 174 to receive the flange portions 170 of the side edge portions 4 and 6. A pair of spaced apart guide and retaining means 176 are secured to the side edge portions 4 and 6 and have lip portions 178 to receive the flange portions 168 of the side edge portions 162 and 164. Locking means are provided for holding the ladders 2 and 160 in different relative positions and comprise a U-shaped pin 180 having one leg portion 182 resiliently held against each side leg portion 162 or 164 by a spring 184. The other leg portion 186 of the U-shaped pin 180 is adapted to be positioned in one of the openings 188 formed in each of the side edge portions 4 and 6.

The ladders 2 and 160 are conventional aluminum ladders. The two support legs 30 and 32 and the one additional support leg 60 are tubes having a circular cross-sectional configuration with an outer diameter of about 1.25 inches and a wall thickness of about 0.0625 inches. Each extension means 56, 58 and 70 are tubes having a circular cross-sectional configuration having an outer diameter of about 1.125 inches and a wall thickness of about 0.0625 inches. When used as an extension ladder, the two support legs 30 and 32 and the one additional leg 60 have lengths only slightly less than the lengths of the side edge members 4, 6, 162 and 164 as illustrated in FIGS. 13 and 15.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A folding step ladder comprising:

a ladder having at least a pair of opposed side leg portions having inner and outer surfaces;

at least three spaced apart steps extending between and fixedly connected to said inner surfaces of said side leg portions and having an upper surface for supporting an user;

said ladder having a top end portion, a bottom end portion, a front side and a back side, a length equal to the longitudinal extent of each of said side leg portions, a width equal to the distance between said outer surfaces of said side leg portions and a depth extending between said front side and said back side;

at least a pair of support legs each having a top end section and a bottom end section;

pivot means for pivotally mounting said top end sections of said pair of support legs on said ladder at said top end portion thereof so that said pair of support legs may be pivotally moved to an opened or closed position, said pair of support legs each pivoting about an axis extending in a depthwise direction and generally parallel to each other;

said pair of support legs having support feet at the bottom thereof and when said pair of support legs have been moved to said opened position, said support feet are spaced apart a distance greater than said width of said ladder;

at least one additional support leg having a top end section and a bottom end section;

pivot means for pivotally mounting said top end section of said additional support leg on said ladder at said top end portion thereof so that said one additional support leg may be pivotally moved to an opened or closed position, said one additional support leg pivoting about an axis extending generally in a widthwise direction.

2. A folding step ladder as in claim 1 and further comprising:

means for preventing pivotal movement of said one additional support leg when said pair of support legs and said one additional support leg are in said closed positions until said pair of support legs have been pivotally moved to said opened position.

3. A folding step ladder as in claim 1 and further comprising:

guide and retaining means for guiding each of said pair of support legs during said pivotal movement thereof.

4. A folding step ladder as in claim 1 and further comprising:

folding brace means for holding said one additional support leg at said opened position spaced from said pair of support legs.

5. A folding step ladder as in claim 4 and further comprising:

guide and retaining means for guiding each of said pair of support legs during said pivotal movement thereof.

6. A folding step ladder as in claim 1 and further comprising:

extension means for each of said pair of support legs and said additional support leg for varying the linear extent thereof so that each of said pair of support legs and said one additional support leg may have a linear extent;

locking means for holding said extension means so that each of said pair of support means and said additional support means may be locked at any desired linear extent so that said ladder may be supported to be in a vertical condition on any supporting surface; and said extension means cooperating with said pair of support legs and said additional support leg so that said extension means and each of said pair of support legs and said additional support leg may have a linear extent greater or lesser than said length of each of said side leg portions.

7. A folding step ladder as in claim 6 and further comprising:

locking means for holding said pair of support legs and said extension means therefor in said closed position for storage or transportation so that the linear extent between said pair of support legs and said extension means therefor is less than said width of said ladder; and retaining means for holding said one additional support leg in said closed position for storage or transportation.

8. A folding step ladder as in claim 7 wherein:

said pair of support legs and said one additional support leg each having a linear extent which is less than said length of each of said side leg portions.

9. A folding step ladder as in claim 8 wherein:

each of said pair of support legs and said additional support leg comprises a hollow tube having inner and outer surfaces and top and bottom ends; and said extension means comprises a tube having an outer cross-sectional configuration substantially the same as but slightly smaller than the inner cross-sectional configuration of said inner surface of each of said pair of support legs and said one additional support leg and mounted therein for sliding telescoping movement into and out of each of said pair of support legs and said one additional support leg at said bottom ends thereof.

10. A folding step ladder as in claim 9 where said folding brace means comprises:

a tubular member mounted for sliding movement over said outer surface of said one additional support leg;

a first pair of spaced apart support arms pivotally connected at one ends thereof to said base member;

a cross member adapted to be grasped by the user;

said first pair of spaced apart support arms connected at the other ends thereof to said cross member;

a second pair of spaced apart support arms connected at one ends thereof to said cross member; and said second pair of spaced apart support arms pivotally connected at their other ends at spaced apart locations on one of said steps wherein said locations are next adjacent to each of said side leg portions.

11. A folding step ladder as in claim 10 wherein said locking means comprises:

a support member fixedly mounted on each of said pair of support legs and said one additional support leg next to said bottom end thereof;

a locking lever having an opening therein having an inner surface having a cross-sectional configuration substantially the same as but slightly larger than said outer cross-sectional configuration of said extension means;

pivot means for pivotally mounting said locking lever on said support member so that said extension means passes through said opening in said locking lever; and spring means connecting said locking lever to said support member and urging said locking lever toward said support member so that portions of said inner surface of said opening move into contact with portions of said outer surface of said extension means to prevent movement of said extension means into each of said pair of support legs and said one additional support leg.

12. A folding step ladder as in claim 11 and further comprising:

means for preventing pivotal movement of said one additional support leg when said pair of support legs and said one additional support leg are in said closed positions until said pair of support legs have been pivotally moved to said opened position.

13. A folding ladder as in claim 1 wherein:

said side leg portions extend in generally parallel directions to each other;

each of said steps extend in generally parallel directions to each other; and further comprising:

extension means for each of said pair of support legs and said additional support leg for varying the linear extent thereof so that each of said pair of support legs and said one additional support leg may have a linear extent;

locking means for holding said extension means so that each of said pair of support means and said additional support means may be locked at any desired linear extent so that said ladder may be supported to be in a vertical condition on any supporting surface; and said extension means cooperating with said pair of support legs and said additional support leg so that said extension means and each of said pair of support legs and said additional support leg may have a linear extent greater or lesser than said length of each of said side leg portions.

14. A folding ladder as in claim 13 wherein said pivot means for pivotally mounting said top end sections of said pair of support legs and said one additional support leg on said top end portion of said ladder comprises:

a support bracket fixedly secured to at least a portion of one of said steps extending between said side leg portions and located at said top end portion of said ladder; and said pivot means are fixedly mounted on said support bracket.

15. A folding ladder as in claim 14 and further comprising:

means for preventing pivotal movement of said one additional support leg when said pair of support legs and said one additional support leg are in said closed positions until said pair of support legs have been pivotally moved to said opened position.

16. A folding ladder as in claim 14 wherein said means for permitting pivotal movement of said one additional support leg comprises:

locking means for holding said pair of support legs and said extension means therefor in said closed position for storage or transportation so that the linear extent between said pair of support legs and said extension means therefor is less than said width of said ladder;

folding brace means for holding said one additional support leg at said opened position; and portions of said folding brace means located between said pair of support legs and said ladder so as to prevent pivotal movement of said one additional support leg.

17. A folding ladder as in claim 16 and further comprising:

guide means for guiding each of said pair of support legs during said pivotal movement thereof.

18. A folding ladder as in claim 17 wherein:

each of said pair of support legs and said additional support leg comprises a hollow tube having inner and outer surfaces and top and bottom ends;

said extension means comprises a tube having an outer cross-sectional configuration substantially the same as but slightly smaller than the inner cross-sectional configuration of said inner surface of each of said pair of support legs and said one additional support leg and mounted therein for sliding telescoping movement into and out of each of said pair of support legs and said one additional support leg at the bottom ends thereof; and wherein said locking means comprises:

a support member fixedly mounted on each of said pair of support legs and said one additional support leg next to said bottom end thereof;

a locking lever having an opening therein having an inner surface having a cross-sectional configuration substantially the same as but slightly larger than said outer cross-sectional configuration of said extension means;

pivot means for pivotally mounting said locking lever on said support member so that said extension means passes through said opening in said locking lever; and spring means connecting said locking lever to said support member and urging said locking lever toward said support member so that portions of said inner surface of said opening in said locking lever move into contact with portions of said outer surface of said extension means to prevent movement of said extension means into each of said pair of support legs and said one additional support leg.

19. A folding ladder as in claim 1 and further comprising:

another ladder having a pair of opposed side leg portions;

at least three steps extending between and connected to each of said side leg portions and having an upper surface for supporting an user;

said another ladder having a top end portion, a bottom end portion, a front side and a back side, a length equal to the longitudinal extent of each of said side leg portions, a width equal to the distance between said side leg portions and a depth extending between said front side and said back side;

movement permitting means connecting said another ladder to said ladder including said pair of support legs and said one additional support leg for permitting relative sliding movement therebetween so that the usable length of said another ladder and said ladder may be increased; and securing means for holding said another ladder and said ladder in various relative locations.

20. A folding ladder as in claim 19 wherein:

said side leg portions of said ladder and said another ladder extending in generally parallel directions to each other; and each of said steps extend in generally parallel directions to each other.

* * * * *